US008424278B2

(12) United States Patent
Goblet

(10) Patent No.: US 8,424,278 B2
(45) Date of Patent: Apr. 23, 2013

(54) DEFORMABLE SEATING PIECE FOR SADDLETREE, SADDLETREE ADAPTED TO RECEIVE SUCH A PIECE AND SADDLE INCLUDING SUCH A COMBINATION

(75) Inventor: Laurent Goblet, Paris (FR)

(73) Assignee: Hermes Sellier, Paris (FR)

( * ) Notice: Subject to any disclaimer, the term of this patent is extended or adjusted under 35 U.S.C. 154(b) by 0 days.

(21) Appl. No.: 12/466,689

(22) Filed: May 15, 2009

(65) Prior Publication Data

US 2009/0282790 A1 Nov. 19, 2009

(30) Foreign Application Priority Data

May 16, 2008 (FR) ..... 08 53204

(51) Int. Cl.
*B68C 1/04* (2006.01)

(52) U.S. Cl.
USPC ..... 54/44.3; 54/44.4

(58) Field of Classification Search ..... 54/44.1, 54/44.3, 44.7
See application file for complete search history.

(56) References Cited

U.S. PATENT DOCUMENTS

| | | | | | |
|---|---|---|---|---|---|
| 9,029 | A * | 6/1852 | Kennedy | ..... | 54/44.7 |
| 30,118 | A * | 9/1860 | Boyd | ..... | 54/44.7 |
| 63,322 | A * | 3/1867 | Snurgin | ..... | 54/44.4 |
| 248,514 | A * | 10/1881 | Shelly | ..... | 54/44.7 |
| 328,232 | A * | 10/1885 | Lambeth | ..... | 54/44.1 |
| 709,904 | A * | 9/1902 | Hastings | ..... | 54/44.7 |
| 5,799,473 | A | 9/1998 | Goblet | | |
| 6,044,630 | A | 4/2000 | Coffin | | |
| 6,588,185 | B1 | 7/2003 | Goblet | | |
| 2003/0205036 | A1 * | 11/2003 | Sala | ..... | 54/44.3 |
| 2006/0059869 | A1 * | 3/2006 | Brown | ..... | 54/44.3 |

FOREIGN PATENT DOCUMENTS

| | | | |
|---|---|---|---|
| DE | 3236079 | A1 * | 4/1983 |
| EP | 0 692 450 | | 1/1996 |
| EP | 1 197 469 | | 4/2002 |
| EP | 1 359 116 | | 11/2003 |
| WO | 02/070400 | | 9/2002 |

OTHER PUBLICATIONS

French Search Report dated Jan. 12, 2009, from corresponding French Application.

* cited by examiner

*Primary Examiner* — Son T Nguyen
(74) *Attorney, Agent, or Firm* — Young & Thompson

(57) ABSTRACT

The invention is directed to a piece (2) for a saddletree (1) of mat-like general shape conformed to have both a first overall concavity in a first direction of a longitudinal plane of symmetry and a second overall concavity in a second direction of a transverse plane, delimited by an exterior free edge (14) including a pommel portion, a cantle portion and two longitudinal portions, the exterior free edge being adapted to cooperate with a complementary interior free edge of the saddletree, the mat including a plurality of individual portions at least partly separate, placed in the vicinity of each other so that each individual portion can absorb forces and be deformed in bending or in torsion at least partly independently of the other individual portions, the piece being provided with elements for associating it with the saddletree.

16 Claims, 4 Drawing Sheets

Figure 1:
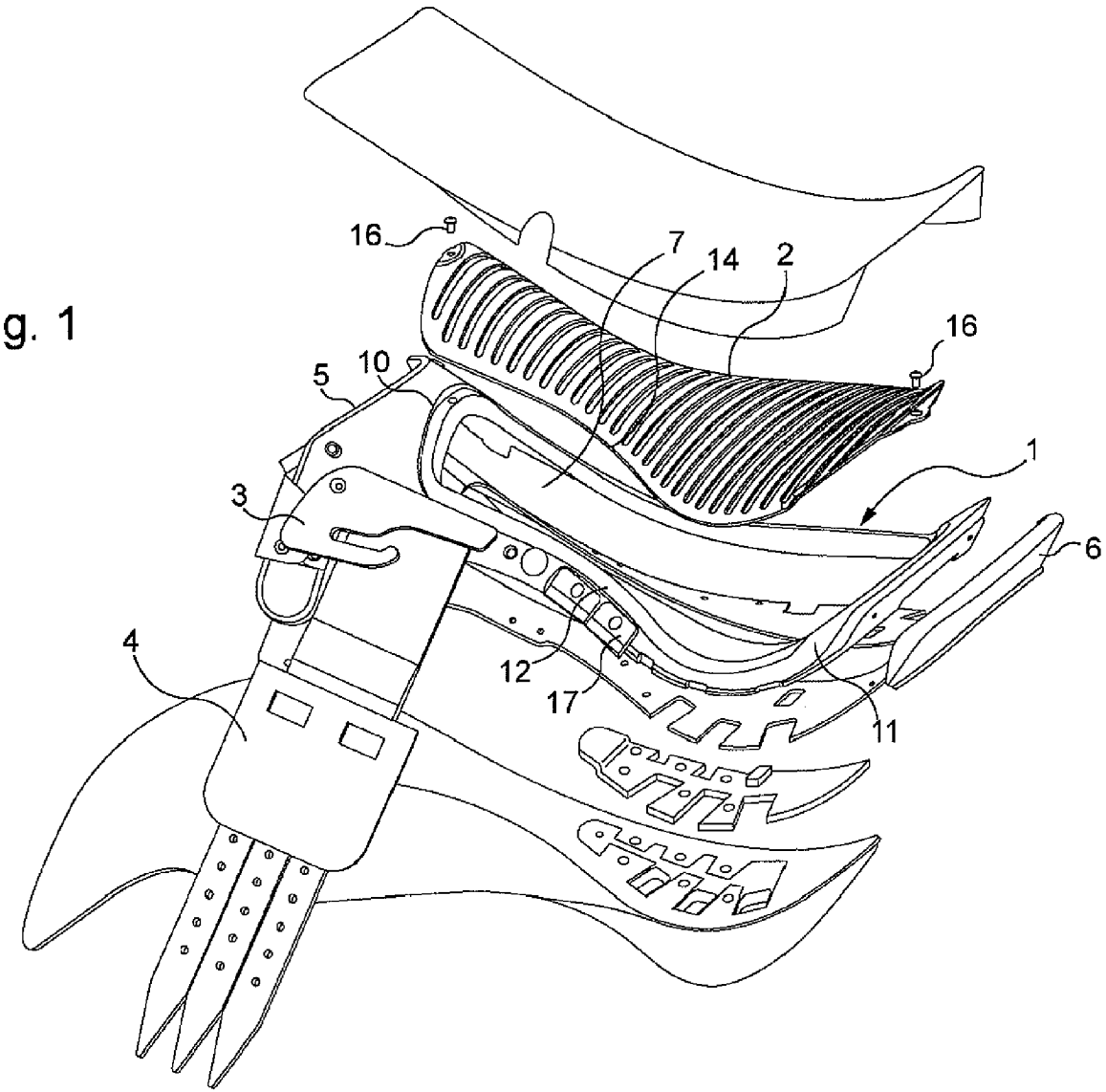

Fig. 6
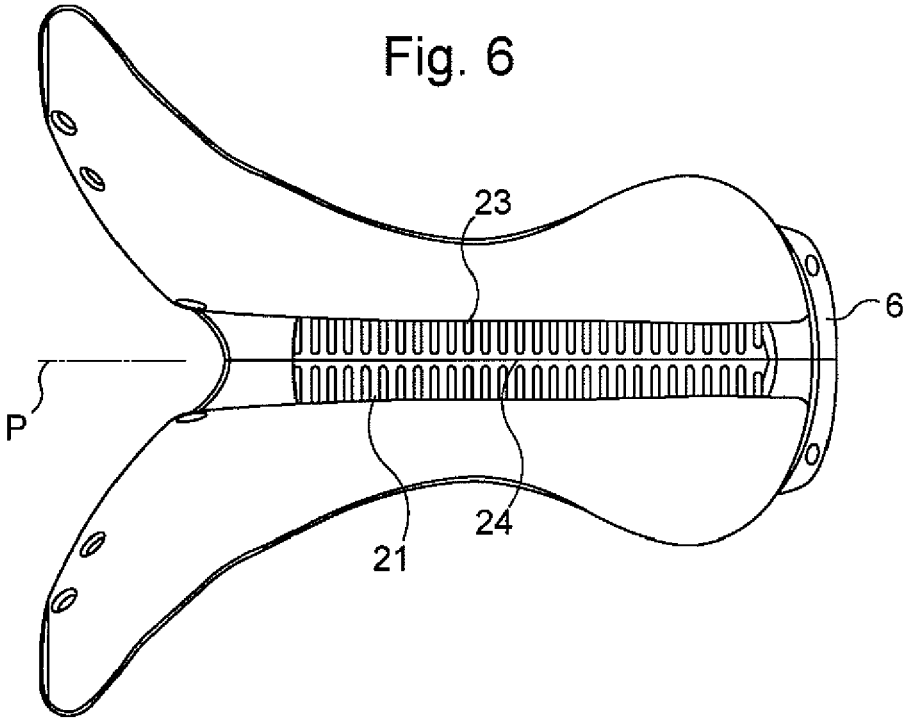
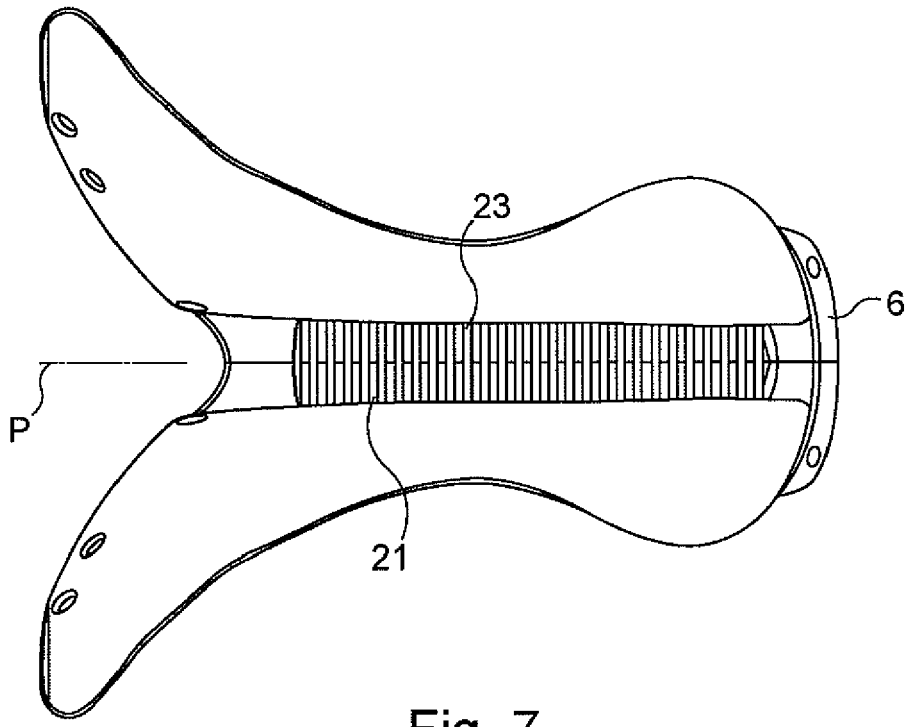
Fig. 7

DEFORMABLE SEATING PIECE FOR SADDLETREE, SADDLETREE ADAPTED TO RECEIVE SUCH A PIECE AND SADDLE INCLUDING SUCH A COMBINATION

The invention concerns a seating piece specifically intended for an equestrian saddle, a saddletree specifically designed to receive such a piece, and a saddle including such a saddletree and such a piece.

The document EP-A-0 692 450 discloses an equestrian saddle having a saddle body with which are associated a girth strap, stirrup leathers and a surcingle. The saddle proper includes an internal rigid saddletree, a seat, padding, two small half-panels, two half-panels and two false half-panels, all three disposed laterally, superposed and placed respectively from the exterior toward the interior of the saddle. The saddletree defines on the saddle a front arch, a pommel and a cantle. Two stirrup leather plates are fixed to the saddletree laterally. In this embodiment, a through-passage is provided for the surcingle.

The document EP-A-1 197 469 discloses a saddletree including a substantially solid one-piece strength member forming pommel, cantle, seating and support for the other components of the saddle, which essentially comprises the one-piece member, produced from materials, such as composite materials, chosen for their ability to be conformed to the required shape for the saddletree, to confer on the saddletree the required qualities of strength and flexibility, and to incorporate into the peripheral portion of the strength member a plurality of members for removably fixing and positioning other components of the saddle, panels, half-panels, false half-panels, counter girth straps, side walls, seat, small half-panels, pommel and cantle backing plates, etc.), taking the form of holes, clips, recesses, reliefs, threaded inserts, loops or the like, so that said parts are positioned and fixed to the strength member by said members.

Such a saddletree facilitates fitting and where applicable replacing the components of the saddle, whilst reducing the weight. The problem is that such a saddletree must have properties that are at least in part contradictory or difficult to reconcile, such as stiffness and flexibility. Moreover, it is now considered that the saddle must be ergonomic not only for the rider but also for the mount.

The invention aims in particular to improve the saddletree and the saddle of the document EP-A-1 197 469 in order to provide a solution to the above problems, at the same time as retaining the benefit of the advantages previously obtained.

To this end, a first aspect of the invention relates to a piece specifically intended to be mounted on a saddletree of a saddle in particular for horses, of mat-like general shape conformed to have both a first overall concavity in a first direction of a longitudinal plane of symmetry and a second overall concavity in a second direction—opposite to the first direction—of a transverse plane, delimited by an exterior free edge including a pommel portion, a cantle portion and two longitudinal portions, said exterior free edge being adapted to cooperate with a complementary interior free edge of the saddletree, the mat comprising a plurality of individual portions at least partly separate, placed side by side—or in the vicinity of each other—so that each individual portion can absorb forces and be deformed in bending or in torsion at least partly independently of the other individual portions, in particular adjacent portions, said piece being provided with means for associating it with the saddletree.

Thus the piece of the invention, combined with a saddletree adapted to receive it, reconciles some stiffness offering good protection of the mount and some flexibility adapted to the comfort of the rider.

In one embodiment, the individual portions are in the form of strips, two adjacent strips being at least partly separated from each other by a slot or free space. In one embodiment, two adjacent strips are furthermore connected to each other by at least one connecting area. The deformation of the piece is therefore essentially limited to the places subjected to particular stresses.

In one embodiment, each strip has a width and a thickness calculated as a function of the stresses that it is liable to have to absorb when the saddle is being used and the required limit deformations, to optimize the deformability of the piece and its strength. In one embodiment, the strips have identical or similar widths and thicknesses.

In one embodiment, the strips extend in a transverse general direction between the two longitudinal portions of the exterior free edge.

In one embodiment, the means of said piece for associating it with the saddletree are holes, notches or openings situated toward its exterior free edge, adapted to have passed through them members adapted to be fixed to the saddletree toward its interior free edge. In particular, the holes, notches or openings are situated toward the two portions of the exterior free edge of said piece forming the pommel and the cantle.

In one embodiment, the hole or holes, notch or notches or opening or openings situated at least toward one of the two portions of the exterior free edge of said piece forming the pommel and the cantle are elongate in the longitudinal direction to enable longitudinal relative displacement of the piece relative to the saddletree on deformation of the piece.

In one embodiment, said piece is produced partly or completely in plastic material or composite material.

A second aspect of the invention relates to a saddletree in particular for equestrian saddles, specifically designed for fitting a piece as just described, which has an overall stiffness and the general shape of an open frame having both a first overall concavity in a first direction of a longitudinal plane of symmetry and a second overall concavity in a second direction—opposite to the first direction—of a transverse plane, delimited by an exterior free edge including a pommel portion, a cantle portion and two longitudinal portions, the interior free edge of the saddletree being adapted to cooperate with a complementary exterior free edge of said piece, said saddletree being provided with means for associating it with the piece.

Accordingly, the saddletree of the invention, combined with a piece as described above, reconciles some stiffness offering good protection of the mount and some flexibility adapted to the comfort of the rider.

In one embodiment, the saddletree has an interior free edge having a peripheral cut-out for seating said piece.

In one embodiment, the means of said saddletree for associating it with said piece are holes, notches or openings situated toward its interior free edge, adapted to enable the fixing of fixing members.

In one embodiment, the means in the form of holes, notches or openings forming the means of the saddletree for associating it with said piece are situated toward the two portions of its interior free edge forming the pommel and the cantle.

In one embodiment, there are incorporated toward the exterior free edge of the saddle tree one or more removable positioning and fixing members for one or more other components of the saddle, taking the form of holes, clips, recesses, reliefs, threaded inserts, loops or the like, so that said elements are positioned and fixed to the saddletree by said members.

A third aspect of the invention relates to a saddle, in particular an equestrian saddle, including a saddletree as just described on which is mounted a piece as just described, said piece being associated with said saddletree by respective association means with which said fixing members cooperate. Accordingly, the saddle of the invention reconciles some stiffness offering good protection of the mount and some flexibility adapted to the comfort of the rider.

Figure 2:
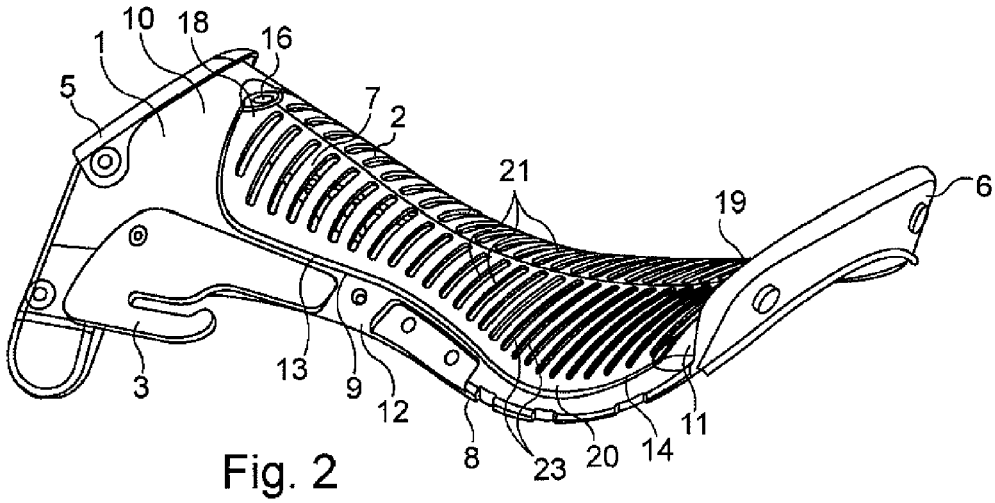
Figure 3:
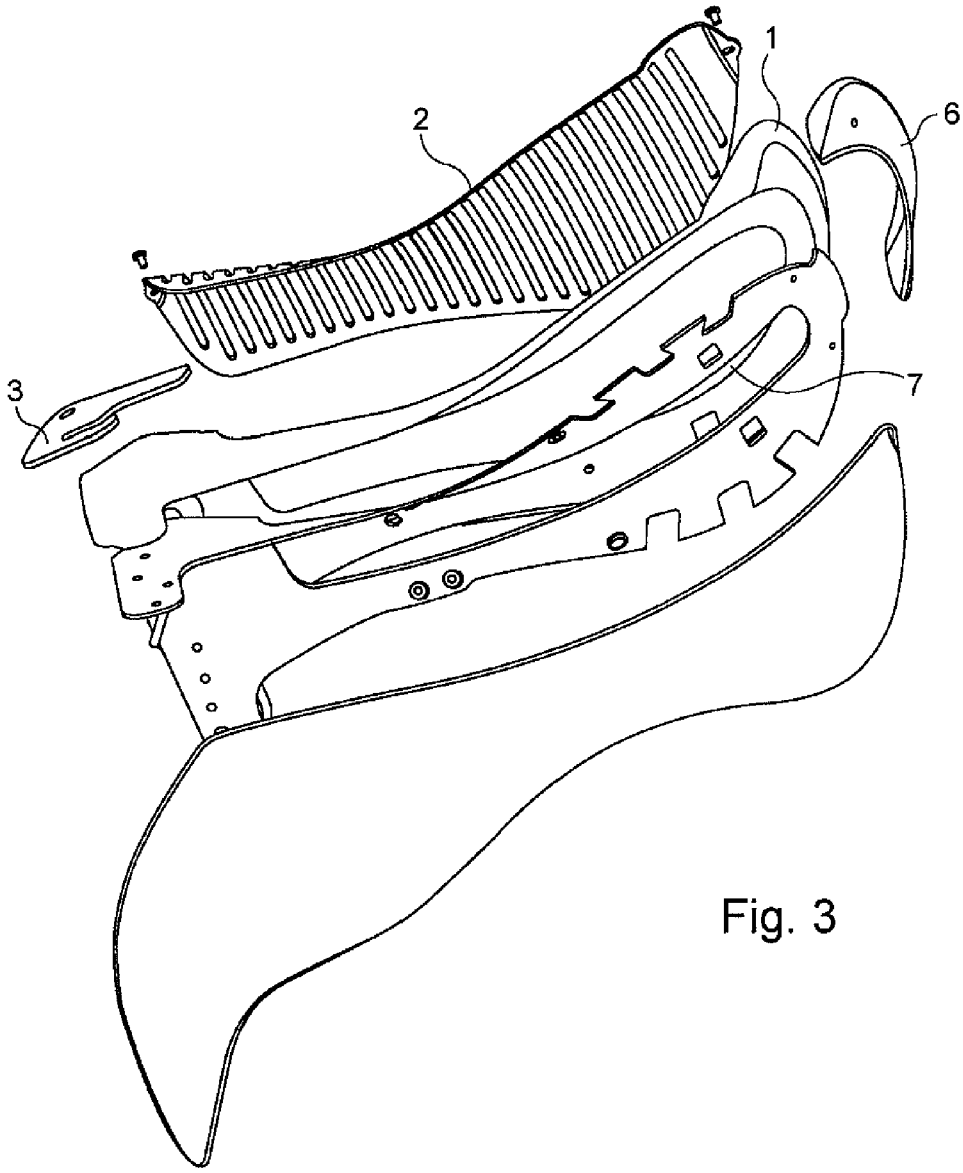
Figure 4:
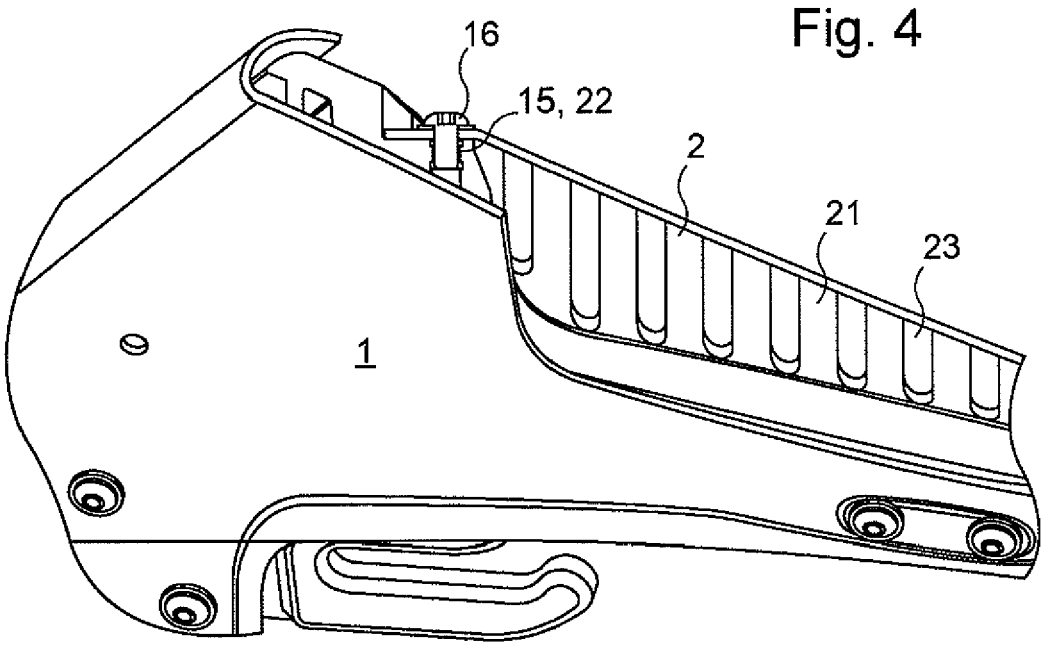
Figure 5:
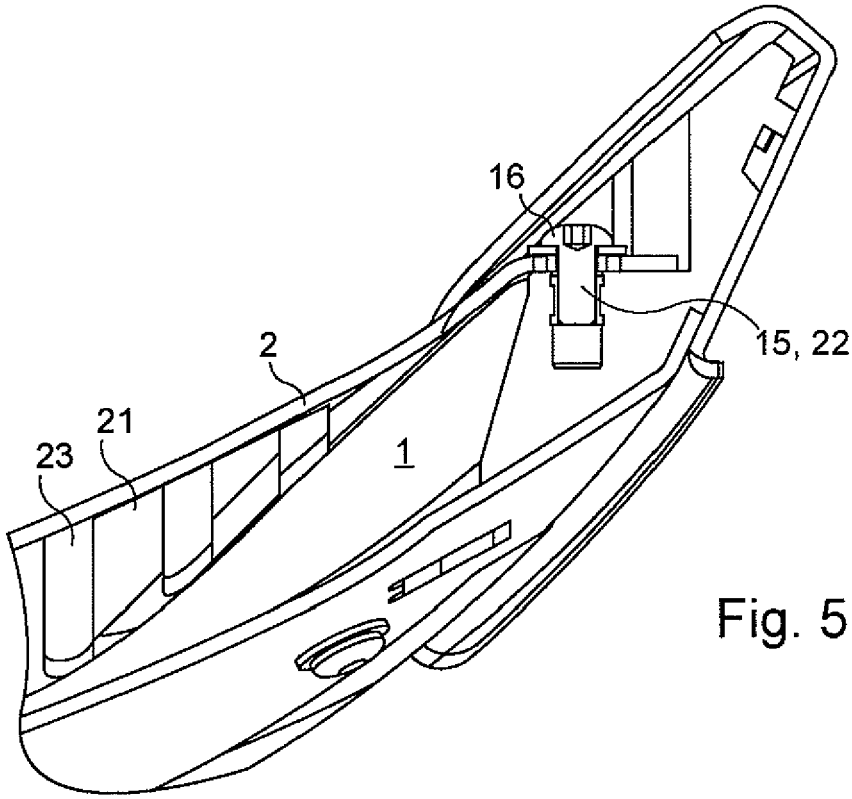

The invention will be better understood on reading the description with reference to the following figures:

FIG. 1 is a partial general exploded perspective view of a saddle of the invention, showing the saddletree and the piece associated with it seen from above, FIG. 2 is a general perspective view showing the saddletree and the associated piece seen from above, FIG. 3 is a general exploded perspective view showing the saddletree and the associated piece seen from below, FIG. 4 is a view in longitudinal section to a larger scale of the assembly comprising the saddletree and the associated piece as seen from the pommel side, FIG. 5 is a view in longitudinal section to a larger scale of the assembly comprising the saddletree and the associated piece as seen from the cantle side, FIG. 6 is a view from below of a first embodiment of the assembly comprising the saddletree and the associated piece, and FIG. 7 is a view from below of a second embodiment of the assembly comprising the saddletree and the associated piece.

The equestrian saddle includes a saddletree 1 and a piece 2 specifically intended to be mounted on the saddletree 1 as described hereinafter.

The saddle also includes two stirrup leather holders, or stirrup plates 3, girth straps 4, a pommel plate 5, also called the saddletree backing plate, a cantle backing plate 6, and, in the conventional way, a seat, half-panels, false-half-panels, seat padding pieces, panel padding pieces, panel fixing inserts, small half-panels, etc.

The saddletree 1 combined with the saddletree backing plate 5 has an overall stiffness.

The saddletree 1 has the general shape of a frame in which there is an opening 7.

The saddletree 1 includes in combination a first overall concavity in a vertical first or downward direction of a longitudinal plane of symmetry P and a second overall concavity in a vertical second or upward direction of a transverse plane.

When the saddle is in the normal position of use, the plane P is disposed vertically or substantially vertically.

The qualifiers "downward", "upward", "vertical", etc. refer to this same normal position of use of the saddle.

The frame of the saddletree 1 is delimited by an exterior free edge 8 and an interior free edge 9.

A portion of the frame of the saddletree 1, thus of its edges 8, 9 forms the pommel 10. Another portion forms the cantle 11. The two portions forming the pommel 10 and the cantle 11 are opposite each other and in the vicinity of the longitudinal plane of symmetry P.

Two portions of the frame of the saddletree 1, thus of its edges 8, 9, form longitudinal portions 12, situated on either side of the plane P.

The interior free edge 9 has a peripheral cutout 13, providing a seating for the exterior free edge 14 of the piece 2.

The saddletree 1 is also provided with means 15 for combining it with the piece 2. These means 15 are holes, notches or openings located toward the interior free edge 9. They are adapted to enable the screwing on of fixing members 16.

In the embodiment represented, the holes, notches or openings 15 are located toward the two portions of its interior free edge forming the pommel 10 and the cantle 11.

Based on the teaching of the document EP-A-1 197 469, the saddletree 1 incorporates toward its exterior free edge 8 one or more members 17 for removably positioning and fixing one or more other components of the saddle such as panels, half-panels, false-half-panels, girth straps, side walls, seat, small-half-panels, pommel and cantle plates, etc.

The members 17 take the form of holes, clips, hollows, reliefs, threaded inserts, loops or the like, so that said components of the saddle are positioned and fixed to the saddletree 1 by the member 17.

The piece 2 is preferably entirely or partly of plastic material or composite material.

The piece 2 has the general shape of a mat conformed so that it can be mounted on the saddletree 1. Consequently, like the saddletree 1, the piece 2 has in combination a first overall concavity in the same vertical first or downward direction of the longitudinal plane of symmetry P and a second overall concavity in the same vertical second or upward direction of the same transverse plane.

The piece 2 is delimited by the exterior free edge 14, which includes a pommel portion 18, a cantle portion 19 and two longitudinal portions 20.

The exterior free edge 14 of the piece 2 is adapted to cooperate with the complementary interior free edge 9 of the saddletree 1, notably by being accommodated in the peripheral cutout 13. It is accommodated here with a clearance so that the piece 2 can be deformed by flattening out relative to the saddletree 1.

The mat forming the piece 2 comprises a plurality of individual portions 21, at least partially separate.

These individual portions 21 are placed one beside—or near—the other, so that each elementary portion 21 can absorb loads and be deformed in bending or in torsion at least partially independently of the other elementary portions 21, in particular the adjacent elementary portions 21.

This constructive disposition combines some overall stiffness, although nevertheless not excluding certain limited deformations, and some localized strength allowing localized deformation as a function of the applied stresses.

Moreover, the piece 2 has means 22 for associating it with the saddletree 1 by means of the members 16.

In the embodiment represented, the elementary portions 21 are in the form of strips, two adjacent strips 21 being at least partly separated from each other by a slot or free space 23. In this embodiment, the strips 21 extend in the transverse general direction, between the two longitudinal portions 20 of the exterior free edge 14.

In the embodiment shown in FIG. 6, two adjacent strips 21 are also connected to each other by a median connecting area 24 situated in the plane P.

In the embodiment represented in FIG. 7, two adjacent strips 21 are not connected to each other by this kind of connecting area between the two longitudinal portions 20, with the result that the slots or free spaces 23 extend continuously from one to the other of these two longitudinal portions.

Each strip 21 has a width and a thickness calculated as a function of the stresses that it is liable to have to absorb when the saddle is being used and required limit deformations. Likewise, the width of the slot or free space 23 is calculated as a function of the stresses that the piece 2 must absorb.

In the embodiment represented, the strips 21 have a width and a thickness identical or similar and the width of the slots or free spaces 23 are identical or similar.

The means 22 are holes, notches or openings situated toward the exterior free edge 14 of the piece 2. In particular, and like the saddletree 1, there are two of them situated towards the two portions of its exterior free edge forming the pommel 18 and the cantle 19.

In one embodiment (FIG. 5), one of the holes, notches or openings 22, namely that situated toward the cantle 19, is elongated in the longitudinal direction to allow longitudinal relative movement of the piece 2 relative to the saddletree 1 on deformation of the piece 2.

The invention claimed is:

1. A saddletree for an equestrian saddle, the saddletree comprising:

a saddletree frame delimited by an exterior free edge and interior free edge which has a seating providing by a peripheral cutout, the interior free edge surrounding an opening that is distinct from said peripheral cutout, said saddletree frame comprising, near said exterior free edge, one or more members for removably positioning and fixing saddle components;

a saddletree backing plate attached to the saddletree frame; and a piece having a mat-like general shape and having a first overall concavity in a first direction of a longitudinal plane of symmetry and a second overall concavity in a second direction opposite to the first direction of a transverse plane, said piece having an exterior free edge including a pommel portion, a cantle portion, and two longitudinal portions, said exterior free edge of said piece cooperating with said seating of said interior free edge of said saddletree frame by being accommodated in said peripheral cutout with a clearance and attached to said interior free edge at said peripheral cutout at distal longitudinal ends thereof so that said piece deforms by flattening relative to said saddletree frame when the saddle is used, said piece comprising a plurality of individual portions at least partly separate, arranged adjacent to each other so that each of said individual portions absorbs forces and is deformed in bending or in torsion at least partly independently of the other said individual portions when said piece is mounted within said saddletree frame, said piece having means for attaching said piece to said saddletree frame at said distal longitudinal ends.

2. The saddletree of claim 1, wherein said individual portions are strips that are orthogonal to the longitudinal plane of symmetry, and two adjacent said strips are at least partly separated from each other by a slot.

3. The saddletree of claim 2, wherein two adjacent said strips are connected to each other by at least one connecting area that extends along the longitudinal plane of symmetry.

4. The saddletree of claim 3, wherein each of said strips has a width and a thickness related to stresses absorbed when the saddletree is being used.

5. The saddletree of claim 3, wherein said strips have identical or substantially similar widths and thicknesses.

6. The saddletree of claim 2, wherein each of said strips has a width and a thickness related to stresses absorbed when the saddletree is being used.

7. The saddletree of claim 2, wherein said strips have identical or substantially similar widths and thicknesses.

8. The saddletree of claim 2, wherein said strips extend in a transverse general direction between said two longitudinal portions of said exterior free edge.

9. The saddletree of claim 2, wherein said means for attaching comprises one of holes, notches, and openings near said exterior free edge and fixing members fixed to said saddletree frame near said interior free edge.

10. The saddletree of claim 1, wherein said means for attaching comprises one of holes, notches, and openings near said exterior free edge and fixing members fixed to said saddletree frame near said interior free edge.

11. The saddletree of claim 10, wherein said one of holes, notches, and openings are near said pommel portion and near said cantle portion.

12. The saddletree of claim 11, wherein said one of holes, notches, and openings are elongate in the longitudinal direction to enable longitudinal relative displacement of said piece relative to said saddletree frame on deformation of said piece.

13. The saddletree of claim 1, wherein said piece is partly or completely at least one of plastic material and composite material.

14. The saddletree of claim 1, wherein said saddletree frame is stiffer than said piece and has an opening of shape and size generally corresponding to that of said piece, wherein said saddletree frame has a first overall concavity in the first direction of the longitudinal plane of symmetry and a second overall concavity in the second direction opposite to the first direction of the transverse plane, wherein said saddletree frame has an exterior free edge including a pommel portion, a cantle portion, and two longitudinal portions, the interior free edge of said saddletree frame being adapted to cooperate with said exterior free edge of said piece, said saddletree frame having means for associating said saddletree frame with said piece.

15. The saddletree of claim 14, wherein said means for associating comprises at least one of holes, notches, and openings situated toward said interior free edge, and said means for associating are adapted to fix fixing members extending through said piece.

16. The saddletree of claim 15, wherein said one of holes, notches, and openings are situated toward said pommel portion and said cantle portion of said saddletree frame.

* * * * *